United States Patent [19]

Vickers et al.

[11] 4,438,071

[45] Mar. 20, 1984

[54] FLUID CATALYST REGENERATION APPARATUS

[75] Inventors: Anthony G. Vickers; David A. Lomas, both of Arlington Heights, Ill.

[73] Assignee: UOP Inc., Des Plaines, Ill.

[21] Appl. No.: 407,681

[22] Filed: Aug. 12, 1982

Related U.S. Application Data

[62] Division of Ser. No. 301,923, Sep. 14, 1981, Pat. No. 4,364,849.

[51] Int. Cl.[3] ..... F27B 15/08; B01J 21/20; B01J 29/38; C10G 11/18

[52] U.S. Cl. ..... 422/109; 208/164; 422/105; 422/106; 422/108; 422/110; 422/111; 422/113; 422/144; 422/146

[58] Field of Search ..... 422/144, 146, 105, 106, 422/108, 109, 110, 111, 113; 252/417, 419; 208/164

[56] References Cited

U.S. PATENT DOCUMENTS

| | | | |
|---|---|---|---|
| 2,492,948 | 1/1950 | Berger | 252/417 |
| 2,506,123 | 5/1950 | Watson . | |
| 2,515,156 | 7/1950 | Jahnig et al. . | |
| 2,596,748 | 5/1952 | Watson et al. | 252/417 |
| 2,819,951 | 5/1958 | Medlin et al. . | |
| 2,862,798 | 12/1958 | McKinney . | |
| 2,873,175 | 2/1959 | Owens . | |
| 2,970,117 | 1/1961 | Harper | 252/417 |
| 3,990,992 | 11/1976 | McKinney | 252/417 |
| 4,219,442 | 8/1980 | Vickers | 252/417 |
| 4,243,634 | 1/1981 | Vickers | 422/144 |
| 4,309,308 | 1/1982 | Vickers | 422/144 X |
| 4,353,812 | 10/1982 | Lomas et al. | 422/144 X |
| 4,371,501 | 2/1983 | Vickers | 422/144 X |
| 4,374,750 | 2/1983 | Vickers et al. | 422/144 X |

*Primary Examiner*—Barry S. Richman

*Attorney, Agent, or Firm*—James R. Hoatson, Jr.; Louis A. Morris; William H. Page, II

[57] ABSTRACT

A catalyst regeneration process and apparatus for the oxidative removal of coke from a coke contaminated fluid catalyst. The process comprises a high temperature coke combustion zone, a catalyst disengagement zone and an external heat removal zone comprising a shell and tube heat exchanger. Catalyst is cooled by passing it through the shell side of the heat exchanger with a cooling medium through the tube side. A mixture of coke contaminated catalyst, oxygen containing gas, and cool regenerated catalyst from the heat removal zone are contacted in the high temperature combustion zone, the temperature of which is controlled by adjusting the rate at which catalyst is passed through the heat exchanger. This rate is adjusted by adjusting the difference in catalyst head between the catalyst inlet and outlet of the heat exchanger and thus the hydraulic driving force which effects catalyst circulation through the heat exchanger.

5 Claims, 2 Drawing Figures

FLUID CATALYST REGENERATION APPARATUS

CROSS REFERENCE TO RELATED APPLICATIONS

This application is a division of our prior copending application Ser. No. 301,923 filed Sept. 14, 1981, now U.S. Pat. No. 4,364,849, issued Dec. 21, 1982 and incorporated herein by reference.

BACKGROUND OF THE INVENTION

The field of art to which this invention pertains is fluid catalyst regeneration. It relates to the rejuvenation of particulated solid, fluidizable catalyst which has been contaminated by the deposition thereupon of coke. The present invention will be most useful in a process for regenerating coke-contaminated fluid cracking catalyst, but it should find use in any process in which coke is burned from a solid, particulated, fluidizable catalyst.

DESCRIPTION OF THE PRIOR ART

The fluid catalytic cracking process (hereinafter FCC) has been extensively relied upon for the conversion of starting materials, such as vacuum gas oils, and other relatively heavy oils, into lighter and more valuable products. FCC involves the contact in a reaction zone of the starting material, whether it be vacuum gas oil or another oil, with a finely divided, or particulated, solid, catalytic material which behaves as a fluid when mixed with a gas or vapor. This material possesses the ability to catalyze the cracking reaction, and in so acting it is surface-deposited with coke, a by-product of the cracking reaction. Coke is comprised of hydrogen, carbon and other material such as sulfur, and it interferes with the catalytic activity of FCC catalysts. Facilities for the removal of coke from FCC catalyst, so-called regeneration facilities or regenerators, are ordinarily provided within an FCC unit. Regenerators contact the coke-contaminated catalyst with an oxygen containing gas at conditions such that the coke is oxidized and a considerable amount of heat is released. A portion of this heat escapes the regenerator with flue gas, comprised of excess regeneration gas and the gaseous products of coke oxidation, and the balance of the heat leaves the regenerator with the regenerated, or relatively coke free, catalyst. Regenerators operating at superatmospheric pressures are often fitted with energy-recovery turbines which expand the flue gas as it escapes from the regenerator and recover a portion of the energy liberated in the expansion.

The fluidized catalyst is continuously circulated from the reaction zone to the regeneration zone and then again to the reaction zone. The fluid catalyst, as well as providing catalytic action, acts as a vehicle for the transfer of heat from zone to zone. Catalyst exiting the reaction zone is spoken of as being "spent," that is partially deactivated by the deposition of coke upon the catalyst. Catalyst from which coke has been substantially removed is spoken of as "regenerated catalyst."

The rate of conversion of the feedstock within the reaction zone is controlled by regulation of the temperature, activity of catalyst and quantity of catalyst (i.e. catalyst to oil ratio) therein. The most common method of regulating the temperature is by regulating the rate of circulation of catalyst from the regeneration zone to the reaction zone which simultaneously increases the catalyst/oil ratio. That is to say, if it is desired to increase the conversion rate an increase in the rate of flow of circulating fluid catalyst from the regenerator to the reactor is effected. Inasmuch as the temperature within the regeneration zone under normal operations is invariably higher than the temperature within the reaction zone, this increase in influx of catalyst from the hotter regeneration zone to the cooler reaction zone effects an increase in reaction zone temperature. It is interesting to note that: this higher catalyst circulation rate is sustainable by virtue of the system being a closed circuit; and, the higher reactor temperature is sustainable by virtue of the fact that increased reactor temperatures, once effected, produce an increase in the amount of coke being formed in the reaction and deposited upon the catalyst. This increased production of coke, which coke is deposited upon the fluid catalyst within the reactor, provides, upon its oxidation within the regenerator, an increased evolution of heat. It is this increased heat evolved within the regeneration zone which, when conducted with the catalyst to the reaction zone, sustains the higher reactor temperature operation.

Recently, politico-economic restraints which have been put upon the traditional lines of supply of crude oil have made necessary the use, as starting materials in FCC units, of heavier-than-normal oils. FCC units must now cope with feedstocks such as residual oils and in the future may require the use of mixtures of heavy oils with coal or shale derived feeds.

The chemical nature and molecular structure of the feed to the FCC unit will affect that level of coke on spent catalyst. Generally speaking, the higher the molecular weight, the higher the Conradson carbon, the higher the heptane insolubles, and the higher the carbon to hydrogen ratio, the higher will be the coke level on the spent catalyst. Also high levels of combined nitrogen, such as found in shale derived oils, will also increase the coke level on spent catalyst. The processing of heavier and heavier feedstocks, and particularly the processing of deasphalted oils, or direct processing of atmospheric bottoms from a crude unit, commonly referred to as reduced crude, does cause an increase in all or some of these factors and does therefore cause an increase in coke level on spent catalyst.

This increase in coke on spent catalyst results in a larger amount of coke burnt in the regenerator per pound of catalyst circulated. Heat is removed from the regenerator in conventional FCC units in the flue gas and principally in the hot regenerated catalyst stream. An increase in the level of coke on spent catalyst will increase the temperature difference between the reactor and the regenerator, and in the regenerated catalyst temperature. A reduction in the amount of catalyst circulated is therefore necessary in order to maintain the same reactor temperature. However, this lower catalyst circulation rate required by the higher temperature difference between the reactor and the regenerator will result in a fall in conversion, making it necessary to operate with a higher reactor temperature in order to maintain conversion at the desired level. This will cause a change in yield structure which may or may not be desirable, depending on what products are required from the process. Also there are limitations to the temperatures that can be tolerated by FCC catalyst without there being a substantial detrimental effect on catalyst activity. Generally, with commonly available modern FCC catalyst, temperatures of regenerated catalyst are usually maintained below 1400° F., since loss of activity would be very severe about 1400°-1450° F. If a relatively common reduced crude such as that derived from Light Arabian crude oil were charged to a conventional FCC unit, and operated at a temperature required for high conversion to lighter products, i.e. similar to that for a gas oil charge, the regenerator temperature would operate in the range of 1600°-1800° F. This would be too high a temperature for the catalyst, require very expensive materials of construction, and give an extremely low catalyst circulation rate. It is therefore accepted that when materials are processed that would give excessive regenerator temperatures, a means must be provided for removing heat from the regenerator, which enbles a lower regenerator temperature, and a lower temperature difference between the reactor and the regenerator.

A common prior art method of heat removal provides coolant filled coils within the regenerator, wich coils are in contact with the catalyst from which coke is being removed. For example, Medlin et al. U.S. Pat. No. 2,819,951, McKinney U.S. Pat. No. 3,990,992 and Vickers U.S. Pat. No. 4,219,442 disclose fluid catalytic cracking processes using dual zone regenerators with cooling coils mounted in the second zone. These cooling coils must always be filled with coolant and thus be removing heat from the regenerator, even during start-up when such removal is particularly undesired, because the typical metallurgy of the coils is such that the coils would be damaged by exposure to the high regenerator temperatures (up to 1350° F.) without coolant serving to keep them relatively cool. The second zone is also for catalyst disengagement prior to passing the flue gas from the system, and may contain catalyst in a dense phase (Medlin et al. and Vickers) or in a dilute phase (McKinney). Coolant flowing through the coils absorbs heat and removes it from the regenerator.

The prior art is also replete with disclosures of FCC processes which utilize dense or dilute phase regenerated fluid catalyst heat removal zones or heat exchangers that are remote from and external to the regenerator vessel to cool hot regenerated catalyst for return to the regenerator. Examples of such disclosures are as set forth in Harper U.S. Pat. No. 2,970,117; Owens U.S. Pat. No. 2,873,175; McKinney U.S. Pat. No. 2,862,798; Watson et al. U.S. Pat. No. 2,596,784; Jahnig et al. U.S. Pat. No. 2,515,156; Berger U.S. Pat. No. 2,492,948; and Watson U.S. Pat. No. 2,506,123.

An important consideration in the above FCC processes involving regenerator heat removal is the method of control of the quantity of heat removed. For example, in Vickers U.S. Pat. No. 4,219,442 the method involves the control of the extent of immersion of cooling coils in a dense phase regenerated catalyst fluidized bed. The disadvantages of this method have been previously discussed, i.e. interference of the cooling coils with unit start-up and catalyst disengagement.

In the above patents, involving utilization of external catalyst coolers, the catalyst is introduced in a first case to either the top of the cooler (e.g. Harper U.S. Pat. No. 2,970,117 and Watson U.S. Pat. No. 2,506,123), in which case the cooled catalyst flows by gravity from the bottom of the cooler and is blown back up into the regenerator by an air stream, or in a second case to the bottom of the cooler (e.g. Berger U.S. Pat. No. 2,492,948 and Jahnig et al. U.S. Pat. No. 2,515,156), in which case sufficient air must be added to the cooler itself to lift the catalyst back up into the regenerator. A serious disadvantage to the process scheme of the first case is that the regenerator must be elevated high above the ground to allow vertical space for the cooler, cooler outlet line, slide valve and associated equipment, thus making it difficult if not impossible to retrofit the cooler to existing regenerators which do not have sufficient height. The process scheme of the second case suffers from the need for extremely high gas velocities to lift the catalyst against the force of gravity. These high velocities are conducive to erosion of the process equipment by the catalyst, and may reduce the density of the catalyst bed to the point of lowering the heat transfer coefficient between the catalyst bed and cooling means.

The present invention enables a high degree of flexibility and efficiency of operation of an FCC regenerator by utilization of a regenerated catalyst cooler or heat exchanger, remote from the FCC regenerator, to which catalyst is introduced at the bottom thereof, but which does not suffer the above shortcomings of such configurations.

SUMMARY OF THE INVENTION

Accordingly, the invention is, in one embodiment, a process for regenerating a coke contaminated fluid catalyst, the process including the steps of:

(a) introducing oxygen containing regeneration gas, coke contaminated fluid catalyst, and cool recycled regenerated catalyst from a source hereinafter described, into a lower locus of a combustion zone maintained at a temperature sufficient for coke oxidation and therein oxidizing coke to produce hot regenerated catalyst and hot flue gas; (b) transporting the hot flue gas and the hot regenerated catalyst from an upper locus of the combustion zone into a regenerated catalyst disengaging zone, wherein the hot regenerated catalyst is separated from the flue gas and collected in a first collection zone at a lower locus of the disengaging zone as a fluidized bed the surface of which is at a first level; (c) transporting a portion of the hot regenerated catalyst from the first collection zone by means of downward gravity flow to the lower locus of a cooling zone separate from and below the disengaging zone wherein the cooling zone heat is withdrawn from the hot regenerated catalyst by indirect heat exchange with a cooling fluid enclosed in a heat exchange means inserted into the cooling zone to produce cool regenerated catalyst, the catalyst being maintained in the cooling zone as a dense phase fluidized bed by passing a fluidizing gas upwardly through such bed; (d) withdrawing the cool regenerated catalyst from the cooling zone by means of the catalyst overfowing from the cooling zone into a second collection zone at a lower locus of the disengaging zone, the catalyst being collected in the second collection zone as a dense phase fluidized bed the surface of wich is at a second level, the first level being of sufficient height above the second level to provide the driving force required to circulate the catalyst through the cooling zone and; (e) transporting the catalyst by means of downward gravity flow from the second collection zone to the lower locus of the combustion zone as the cooled recycled regenerated catalyst.

In a second embodiment, the invention is an apparatus for regenerating a coke contaminated, fluid catalyst which apparatus comprises in combination: (a) a vertically oriented combustion chamber; (b) a disengagement chamber located superadjacent to and above the combustion chamber; (c) a high level catalyst collection section at the bottom of the disengagement chamber; (d) a first conduit effecting communication between the combustion chamber and the disengagement chamber having at least one outlet opening positioned above the high level catalyst collection section so that catalyst will flow from the first conduit into the high level catalyst collection section; (e) a low level catalyst collection section at the bottom of the disengagement chamber separated from the high level catalyst collection section by means of baffles such that the level of a fluidized catalyst bed filling the high level catalyst collection section will be higher than the level of a fluidized catalyst bed maintained in the low level catalyst collection section; (f) a shell and tube heat exchanger of vertical orientation, remote from the combustion and disengagement chamber, having a catalyst inlet in the shell side of the heat exchanger and the upper end of the shell being in open communication with the bottom of the low level catalyst collection section; (g) a hot catalyst conduit connecting the high level catalyst collection section of the disengagement chamber with the shell side heat exchanger inlet, such that hot regenerated catalyst can flow from the disengagement chamber to the heat exchanger; (h) a cooled catalyst conduit connecting the bottom of the low level catalyst collection section with a lower portion of the combustion chamber such that cooled catalyst which overfows from the shell side of the heat exchanger into the low level catalyst collection section can flow to the lower portion of the combustion chamber; (i) a fluidizing gas inlet conduit connected to a bottom portion of the shell side of the heat exchanger, such that fluidizing gas can pass into the shell side and maintain a fluidized catalyst bed therein; (j) inlet and outlet conduits connected to the tubes of the heat exchanger, such that a cooling fluid can flow through the tubes.

Other embodiments of the present invention encompass further details such as process streams and the function and arrangement of various components of the apparatus, all of which are hereinafter disclosed in the following discussion of each of these facets of the invention.

The above described drawings are intended to be schematically illustrative of the present invention and not be limitations thereon.

DETAILED DESCRIPTION OF THE INVENTION

The present invention, in its process aspects, comprises steps for the regenerative combustion within a combustion zone of the coke contaminated catalyst from a reaction zone to form hot flue gas and hot regenerated catalyst, disengagement and collection of the hot regenerated catalyst, cooling of a portion of the hot regenerated catalyst within a heat removal zone, using the cooled regenerated catalyst as a heat sink, and the possible use of the cooled regenerated catalyst for control of the temperatures of the combustion zone. As used herein, the term "hot regenerated catalyst" means regenerated catalyst at the temperature leaving the combustion zone, from about 1300° F. to about 1400° F., while the term "cool regenerated catalyst" means regenerated catalyst at the temperature leaving the cooling zone, about 200° F. less than the temperature of the hot regenerated catalyst.

Figure 1:
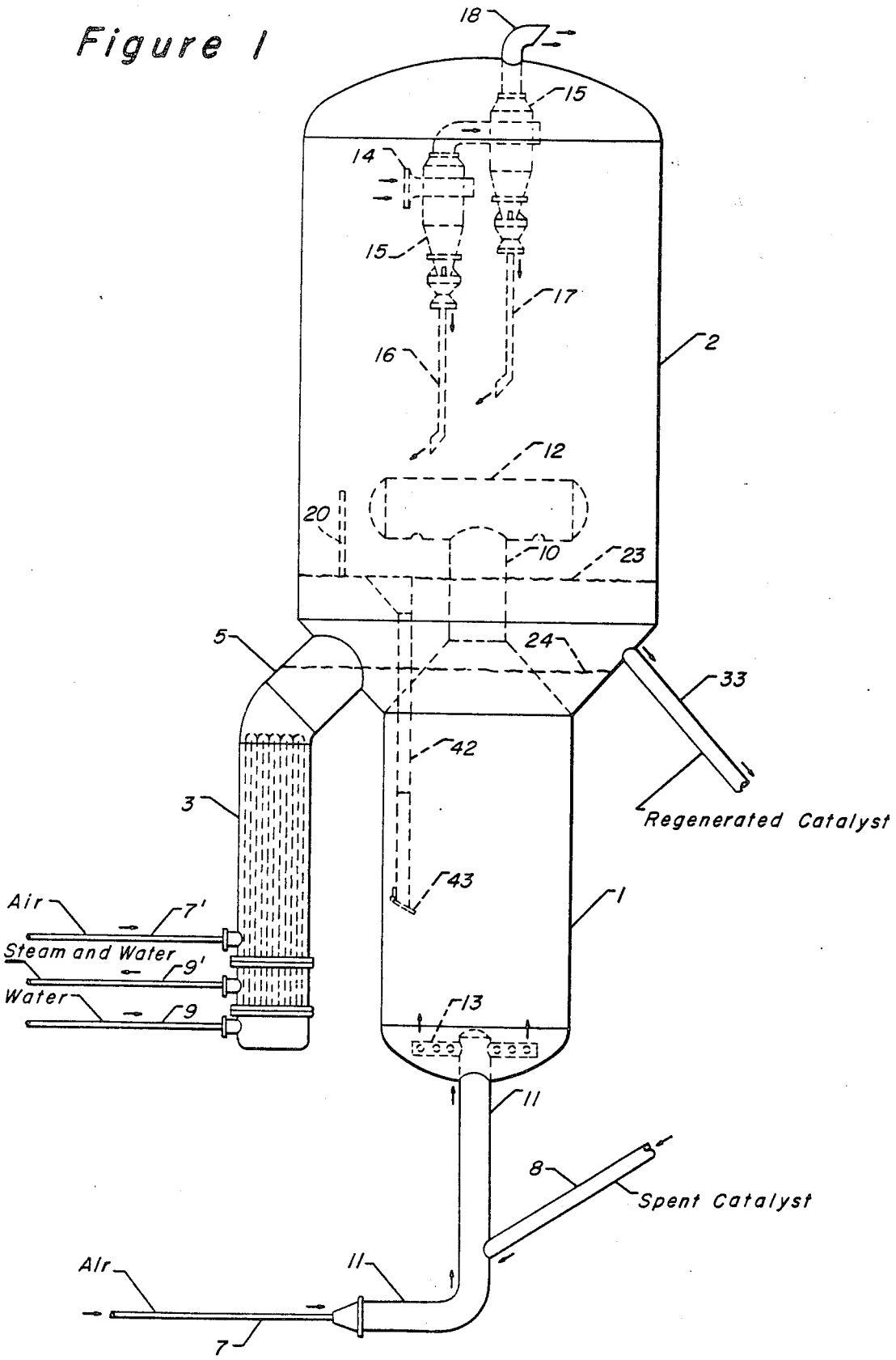
FIG. 1 is a sectional, elevation view of a regeneration apparatus according to the present invention, showing combustion zone 1, disengagement zone 2, cooling zone (heat exchanger) 3, and cooled catalyst discharge conduit 5.

Reference will now be made to the attached drawings for a discussion of the regeneration process and apparatus of the invention. In FIG. 1 regeneration gas, which may be air or another oxygen containing gas, enters in line 7 and mixes with coke contaminated catalyst entering in conduit 8. These streams are shown as flowing together into mixing conduit 11, although each stream could flow individually into combustion zone 1. The resultant mixture of coke contaminated catalyst, and regeneration gas are distributed into the interior of combustion zone 1, at a lower locus thereof, via conduit 11 and distributor 13. Also introduced into his lower locus is cool regenerated catalyst from catalyst recycle conduit 6 as will be hereinafter discussed. Coke contaminated catalyst commonly contains from about 0.1 to about 5 wt.% carbon, as coke. Coke is predominantly comprised of carbon, however, it can contain from about 5 to about 15 wt.% hydrogen, as well as sulfur and other materials.

Notwithstanding the above, depending on the total catalyst loading of the regeneration gas and on the gas velocity, there may be a dense phase at the bottom of the combustion zone. Under normal design conditions for the FCC combustion zone, this dense phase may extend upwards for up to one quarter of the combustion zone length. The dense phase region provides mixing of the spent catalyst from the reactor and the catalyst recirculated via catalyst recycle conduit 6 before it is passed into the dilute phase of the combustion zone, and may therefore be advantageous without compromising the principal advantage of high efficiency coke oxidation that is achieved in the dilute phase combustion zone.

The rising catalyst/gas stream flows through passageway 10 and impinges upon surface 12, which impingement changes the direction of flow of the stream. It is well known in the art that impingement of a fluidized particulate stream upon a surface, causing the stream to turn through some angle, can result in the separation from the stream of a portion of the solid material therein. The impingement of the catalyst/gas stream upon surface 12 causes almost all of the hot regenerated catalyst flowing from the combustion zone to disengage from the flue gas and fall to the bottom portion of disengagement zone 2. The gaseous products of coke oxidation and excess regeneration gas, or flue gas, and the very small uncollected portion of hot regenerated catalyst flow up through disengagement zone 2 nd enters separation means 15 through inlet 14.

These separation means may be cyclone separators, as schematically shown in the Figures, or any other effective means for the separation of particulated catalyst from a gas stream. Catalyst separated from the flue gas falls to the bottom of disengagement zone 2 through conduits 16 and 17. The flue gas exits disengagement zone 2 via conduit 18, through which it may proceed to associated energy recovery systems. Having the disengagement zone in upward communication with the combustion zone is advantageous, in comparison to schemes in which the gas/catalyst mixture flows upward into a relatively dense phase heat removal zone, in that, with the former, there is a substantial reduction in the loading of the regenerator cyclones which virtually eliminates large losses of catalyst from FCC units during operational upsets.

Figure 2:
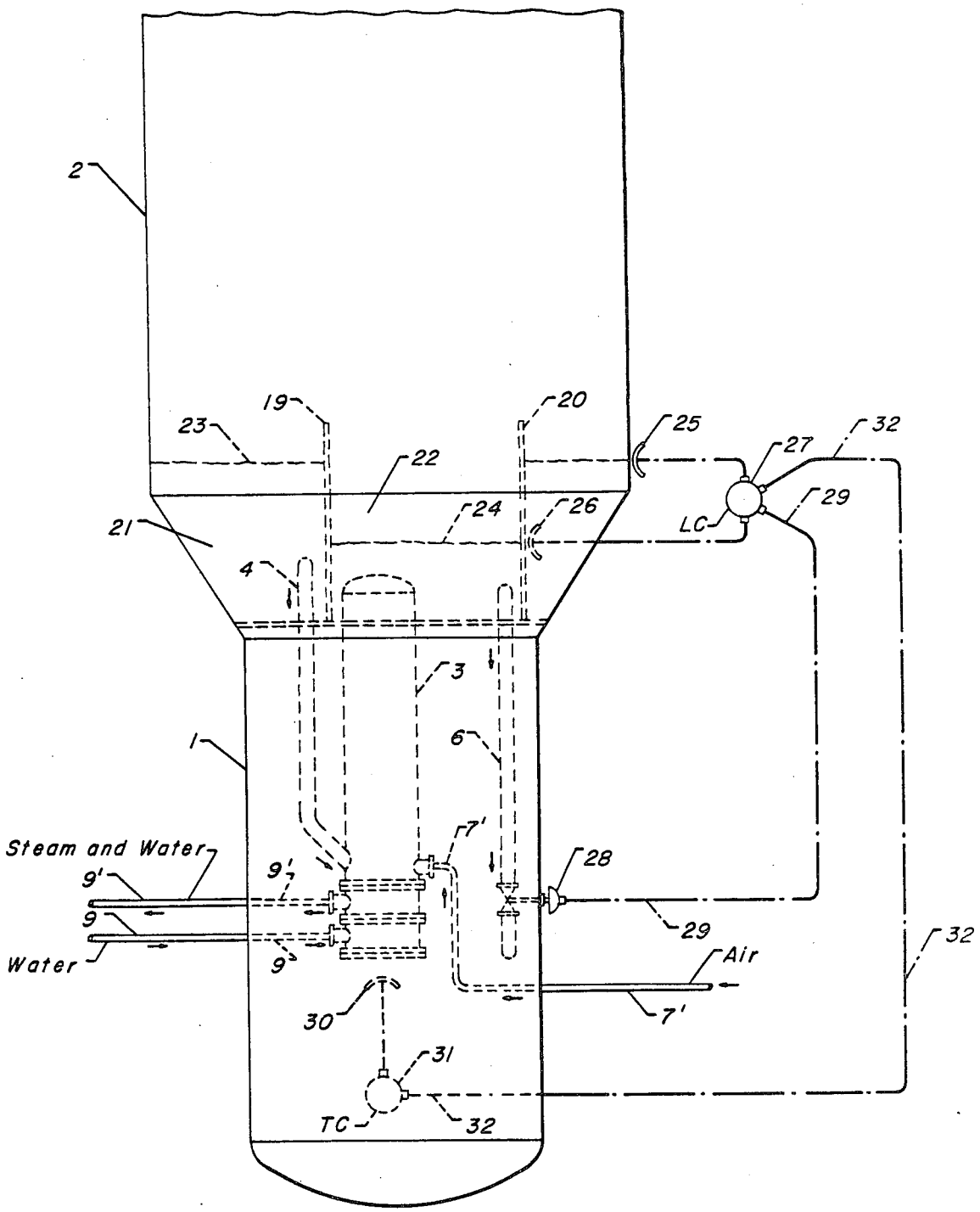
FIG. 2 is a sectional elevation view of a portion of the apparatus of FIG. 1 from a different perspective showing heat exchanger inlet conduit 4 and cool regenerated catalyst recycle conduit 6, as well as various details showing the interconnection of heat exchanger 3 with disengagement zone 2.

With further reference to FIG. 1, the catalyst collection area at the bottom of the disengagement zone, preferably an annular trough as shown, is divided into two collection zones by a system of baffles, which can be seen in FIG. 2 as baffles 19 and 20. Substantially all catalyst entering the disengagement zone falls into first collection zone 21 from at least one outlet opening from passageway 10 positioned above zone 21. Baffles 19 and 20 also create second collection zone 22. The level 23 of the dense phase catalyst bed in zone 21 is maintained at a higher level than the level 24 of the dense phase catalyst bed in zone 22 by means hereinafter discussed. Catalyst from collection zone 21 is passed in dense phase, via hot catalyst conduit 4, downwardly into cooling zone 3 which is shown as a shell and tube heat exchanger. Conduit 4 connects to the shell side of heat exchanger 3. Heat exchanger 3 will be of vertical orientation with the catalyst flowing into the shell and the heat exchanger medium passing through the tubes via lines 9 and 9'. The preferred heat exchange medium would be water, which would change at least partially from liquid to gas phase when passing through the tubes. The tube bundle in the heat exchanger will preferably be of the "bayonet" type wherein one end of the bundle is unattached, thereby minimizing problems due to the expansion and contraction of the heat exchanger components when exposed to and cooled from the very high regenerated catalyst temperatures. The heat transfer that occurs is, from the catalyst, through the tube walls and into the heat transfer medium. Fluidizing gas, preferably air, is passed into a lower portion of the shell side of heat exchanger 3 via line 7', thereby maintaining a desne phase fluidized catalyst bed in the shell side. This fluidized bed will overflow into collection zone 22 from the upper end of the shell of heat exchanger 3 which is in open communication with the bottom of collection zone 22. The catalyst is thus circulated through heat exchanger 3 by virtue of the hydraulic head created by the difference between levels 23 and 24.

At this point, further discussion is warranted to clarify the distinction between the above means of circulating catalyst through heat exchanger 3 and the corresponding means of the above mentioned U.S. Pat. No. 2,492,948 to Berger and U.S. Pat. No. 2,515,156 to Jahnig et al. With reference to the drawings of those patents, in Berger the inlet to cooling chamber 3 at the top of annular space 5 is at a lower level than the outlet at the top of shell 6*a*. In Jahnig et al it is the same catalyst head at level 96 in vessel 86 above both the inlet and outlet of coolers 169. Therefore, and in contradistinction to the present invention, neither of these patents teach catalyst circulation by means of a hydraulic head, but must rely entirely on the lifting force of the fluidizing gas which is achieved only by extremely high velocities of such gas with the aforementioned concomitant detrimental results.

The quantity of catalyst circulated through heat exchanger 3, and thereby the quantity of heat removed from the system, is controllably maintained by controlling height of level 24 by controlling the quantity of catalyst transported from collection zone 22 to the lower locus of combustion zone 1 via conduit 6, the height of level 23 being held constant. Control means for accomplishing such control is shown in FIG. 2. Level sensors 25 and 26 sense the height of levels 23 and 24 and transmit the heights so sensed to level controller 27. Level controller 27 has an adjustable set point and develops an output signal in accordance with such set point and the difference in the measured heights of levels 23 and 24. This signal is transmitted to control valve 28 in conduit 6 via transmitting means 29. Control valve 28 is then adjusted responsive to this height differential, thereby regulating the flow of catalyst from collection zone 22 and maintaining the desired level differential between the collection zones in view of level 23 in zone 21 being held substantially constant. Level 23 may be held constant by allowing collection zone 21 to operate catalyst full and to overflow baffles 19 and 20 into collection zone 22, or , as shown in FIG. 1 by use of an optional dipleg or standpipe 42 with bottom flapper valve 43 and weir 44 extending up into zone 21 to the desired level. Catalyst in zone 21 will overflow into weir 44 and, thus, will not exceed the height of the lip of weir 44. When the force exerted by the head of catalyst filling dipleg 42 on flapper valve 43 exceeds that pressure required to open valve 43, i.e. overcome the force exerted by the spring or counterweight holding the valve closed, catalyst will empty from the dipleg into combustion chamber 1. The flapper valve and/or head of catalyst in the dipleg also serve to prevent undesired reversal of flow up the dipleg.

It is also possible to controllably maintain the temperature at a selected locus of combustion zone 1, preferably a lower locus, by controlling the quantity of catalyst circulated through heat exchanger 3 in response to that temperature. Referring to FIG. 2, temperature sensor 30 senses the temperature at a point in a lower locus of combustion zone 1 and transmits a signal representing the temperature so sensed to temperature controller 31. Temperature controller 31 has an adjustable set point and develops an output signal in accordance with such set point and the temperature sensed. This signal is transmitted to level controller 27 via transmitting means 32. The adjustable set point of level controller 27 is then adjusted responsive to the temperature sensed. As the level controller set point is adjusted it will in turn regulate the flow of catalyst through the heat exchanger and thus the quantity of heat removed from the catalyst so as to control the temperature at the desired location.

The above scheme provides the ability to remove heat from the FCC regenerator as required to maintain a maximum combustion zone temperature and at the same time maintain a high degree of stable steady state operation conducive to the controllability and efficiency of the regenerator, all while enjoying the flexibility and ease of operation of an external catalyst heat exchanger not requiring bulky process equipment below the heat exchanger and at the same time avoiding undesirable high gas-borne catalyst velocities in the heat exchanger.

What is claimed is:

1. Apparatus for regenerating a coke contaminated, fluid catalyst which apparatus comprises in combination:

(a) a vertically oriented combustion chamber;

(b) a disengagement chamber located superadjacent to and above said combustion chamber;

(c) a high level catalyst collection section at the bottom of said disengagement chamber;

(d) a first conduit effecting communication between said combustion chamber and said disengagement chamber having at least one outlet opening positioned above said high level catalyst collection section so that catalyst will flow from said first conduit into said high level catalyst collection section;

(e) a low level catalyst collection section at the bottom of said disengagement chamber separated from said high level catalyst collection section by means of baffles such that the level of a fluidized catalyst bed filling said high level catalyst collection section will be maintained higher than the level of a fluidized catalyst bed maintained in said low level catalyst collection section;

(f) a shell and tube heat exchanger of vertical orientation, remote from said combustion and disengagement chamber, having a catalyst inlet in the shell side of said heat exchanger and the upper end of the shell being in open communication with the bottom of said low level catalyst collection section;

(g) a hot catalyst conduit connecting said high level catalyst collection section of said disengagement chamber with said shell side heat exchanger inlet, such that hot regenerated catalyst can flow from said disengagement chamber to said heat exchanger;

(h) a cooled catalyst conduit connecting the bottom of said low level catalyst collection section with a lower portion of said combustion chamber, such that cooled catalyst which overflows from said shell side of said heat exchanger into said low level catalyst collection section can flow to said lower portion of said combustion chamber;

(i) a fluidizing gas inlet conduit connected to a bottom portion of the shell side of said heat exchanger, such that fluidizing gas can pass into said shell side and maintain a fluidized catalyst bed therein;

(j) inlet and outlet conduits connected to said tubes of said heat exchanger, such that a cooling fluid can flow through said tubes.

2. The apparatus of claim 1 wherein a dipleg comprising a conduit of vertical orientation passes from the bottom of said high level catalyst collection section of said disengagement chamber to a lower portion of said combustion chamber, the inlet of said dipleg being a weir the lip of which is located at the maximum level desired in said high level catalyst collection section, and there being a valve at the outlet of said dipleg which permits the flow of catalyst only downward through said dipleg, said dipleg thereby serving as a maximum level control means in said high level catalyst collection section.

3. The apparatus of claim 1 wherein the bottom portion of said disengagement chamber comprises an annular trough with said high level catalyst collection section being separated from said low level catalyst collection section by vertical baffles.

4. The apparatus of claim 1 wherein there is included a control valve placed in said cooled catalyst conduit, and a control system comprising means to sense the differential level from the level of the catalyst bed in said high level catalyst collection section to the level of the catalyst bed in said low level catalyst collection section, level control means having an adjustable set point connecting with said level differential sensing means and developing an output signal, and means for transmitting said output signal to said control valve whereby the latter is adjusted responsive to said level differential, thereby regulating the flow of catalyst from said low level catalyst collection section and maintaining a desired differential level between said catalyst collection sections and thereby the desired catalyst flow through said heat exchanger.

5. The apparatus of claim 4 wherein there is included a control system comprising means to sense the temperature at a selected location in said combustion chamber, temperature control means having an adjustable set point connecting with said temperature sensing means and developing an output signal, and means for transmitting said output signal to said differential level control system whereby the adjustable set point of the latter is adjusted responsive to said temperature, thereby regulating the flow of catalyst through said heat exchanger and the quantity of heat removed from said catalyst so as to control said temperature at said desired location.

* * * * *